US011533558B2

(12) United States Patent
Tao et al.

(10) Patent No.: US 11,533,558 B2
(45) Date of Patent: Dec. 20, 2022

(54) ACOUSTIC TRANSDUCER AND DRIVING METHOD THEREOF

(71) Applicant: BOE TECHNOLOGY GROUP CO., LTD., Beijing (CN)

(72) Inventors: Yongchun Tao, Beijing (CN); Yichi Zhang, Beijing (CN); Jingwen Guo, Beijing (CN)

(73) Assignee: BEIJING BOE TECHNOLOGY DEVELOPMENT CO., LTD., Beijing (CN)

( * ) Notice: Subject to any disclaimer, the term of this patent is extended or adjusted under 35 U.S.C. 154(b) by 52 days.

(21) Appl. No.: 17/259,245

(22) PCT Filed: Mar. 30, 2020

(86) PCT No.: PCT/CN2020/082000
§ 371 (c)(1),
(2) Date: Jan. 11, 2021

(87) PCT Pub. No.: WO2021/195827
PCT Pub. Date: Oct. 7, 2021

(65) Prior Publication Data

US 2022/0141580 A1 May 5, 2022

(51) Int. Cl.
*H04R 3/00* (2006.01)
*H04R 1/28* (2006.01)
(Continued)

(52) U.S. Cl.
CPC ..... *H04R 3/002* (2013.01); *H04R 1/288* (2013.01); *H04R 1/403* (2013.01); *H04R 3/12* (2013.01);
(Continued)

(58) Field of Classification Search
CPC ..... H04R 3/002; H04R 1/288; H04R 1/403; H04R 3/12; H04R 19/02; H04R 29/001;
(Continued)

(56) References Cited

U.S. PATENT DOCUMENTS 4,140,992 A 2/1979 Wardle
6,370,085 B1 4/2002 Finkle et al.
(Continued)

FOREIGN PATENT DOCUMENTS

CN 101458230 A 6/2009
CN 103336053 A 10/2013
(Continued)

OTHER PUBLICATIONS

China Patent Office, CN202080000428.X First Office Action dated Apr. 29, 2022.

*Primary Examiner* — Jason R Kurr
(74) *Attorney, Agent, or Firm* — Houtteman Law LLC

(57) ABSTRACT

An embodiment of the present disclosure provides a method for driving an acoustic transducer, including: obtaining a reference electrical signal according to a first electrical signal output by a first acoustic transducer element in a case where sound waves are not received by the first acoustic transducer element; obtaining an actual detected electrical signal according to a second electrical signal output by a second acoustic transducer element in a case where sound waves are received by the second acoustic transducer element; and performing a noise reduction process on the actual detected electrical signal according to the reference electrical signal to obtain a noise-reduced signal as a final output electrical signal of the second acoustic transducer element in a case where sound waves are received by the second acoustic transducer element. An embodiment of the present disclosure further provides an acoustic transducer.

14 Claims, 5 Drawing Sheets

(51) Int. Cl.

| | |
|---|---|
| ***H04R 1/40*** | (2006.01) |
| ***H04R 3/12*** | (2006.01) |
| ***H04R 19/02*** | (2006.01) |
| ***H04R 29/00*** | (2006.01) |

(52) U.S. Cl.
CPC ..... *H04R 19/02* (2013.01); *H04R 29/001* (2013.01); *H04R 2201/003* (2013.01); *H04R 2430/01* (2013.01)

(58) Field of Classification Search
CPC ..... H04R 2201/003; H04R 2430/01; B06B 1/00; B06B 1/0607; B06B 1/0629
See application file for complete search history.

(56) References Cited

U.S. PATENT DOCUMENTS

| | | | | |
|---|---|---|---|---|
| 2010/0054495 | A1* | 3/2010 | Harney | H04R 1/04 381/92 |
| 2013/0155817 | A1 | 6/2013 | Kim | |
| 2013/0293065 | A1* | 11/2013 | Hajati | B06B 1/0629 310/334 |
| 2018/0063617 | A1* | 3/2018 | Ohtsuka | H04R 1/08 |
| 2021/0093296 | A1* | 4/2021 | Zhou | A61B 8/546 |

FOREIGN PATENT DOCUMENTS

| | | | |
|---|---|---|---|
| CN | 203465417 | U | 3/2014 |
| CN | 110100294 | A | 8/2019 |
| KR | 20120024130 | A | 3/2012 |
| WO | WO 2012087678 | A2 | 6/2012 |

* cited by examiner

ACOUSTIC TRANSDUCER AND DRIVING METHOD THEREOF

TECHNICAL FIELD

The technical solutions of the present disclosure relate to an acoustic transducer and a driving method thereof.

BACKGROUND

Ultrasonic testing has been applied in many fields, such as medical imaging, medical treatment, industrial flowmeters, automotive radars, and indoor positioning. In a specific system (e.g. a medical imaging system) to which ultrasonic testing is applied, noises may include the noise of sensor itself, the noise of a circuit, and the noise of the system. Since the noise of sensor itself is generated at a front end of the system and amplified synchronously by the amplifiers at various stages in a whole circuit system, the signal-to-noise ratio and detection sensitivity of the whole system are affected. Therefore, it is of great importance how to reduce or even eliminate the noise of the sensor itself.

SUMMARY

The embodiments of the present disclosure provide an acoustic transducer and a driving method thereof.

In the first aspect, an embodiment of the present disclosure provides a method for driving an acoustic transducer, including: obtaining a reference electrical signal according to a first electrical signal output by a first acoustic transducer element in a case where sound waves are not received by the first acoustic transducer element; obtaining an actual detected electrical signal according to a second electrical signal output by a second acoustic transducer element in a case where sound waves are received by the second acoustic transducer element; and performing a noise reduction process on the actual detected electrical signal according to the reference electrical signal to obtain a noise-reduced signal as a final output electrical signal of the second acoustic transducer element in a case where sound waves are received by the second acoustic transducer element.

In some embodiments, performing the noise reduction process on the actual detected electrical signal according to the reference electrical signal specifically includes: performing a difference process on the actual detected electrical signal and the reference electrical signal.

In some embodiments, the first acoustic transducer element and the second acoustic transducer element are one and the same acoustic transducer element.

In some embodiments, the first acoustic transducer element and the second acoustic transducer element are separate acoustic transducer elements. The first acoustic transducer element includes the same number of acoustic transducer units as acoustic transducer units in the second acoustic transducer element. The first acoustic transducer element further includes a sound-muffling layer configured to shield sound waves, so as to prevent the acoustic transducer units in the first acoustic transducer element from being affected by the sound waves.

In some embodiments, obtaining the reference electrical signal according to the first electrical signal output by the first acoustic transducer element in a case where sound waves are not received by the first acoustic transducer element includes: acquiring the first electrical signal output by the first acoustic transducer element in a case where sound waves are not received by the first acoustic transducer element; and performing low-noise amplification and analog-to-digital conversion processes on the first electrical signal to obtain the reference electrical signal. Obtaining the actual detected electrical signal according to the second electrical signal output by the second acoustic transducer element in a case where sound waves are received by the second acoustic transducer element includes: acquiring the second electrical signal output by the second acoustic transducer element in a case where the sound waves are received by the second acoustic transducer element; and performing the low-noise amplification and analog-to-digital conversion processes on the second electrical signal to obtain the actual detected electrical signal.

In the second aspect, an embodiment of the present disclosure further provides an acoustic transducer. The acoustic transducer includes a plurality of acoustic transducer elements on a base substrate and including an acoustic transducer reference element and an acoustic transducer operating element.

The acoustic transducer reference element includes the same number of acoustic transducer units as acoustic transducer units in the acoustic transducer operating element.

The acoustic transducer reference element further includes a sound-muffling layer, which is configured to shield sound waves, so as to prevent the acoustic transducer units in the acoustic transducer reference element from being affected by the sound waves.

In some embodiments, the sound-muffling layer and the base substrate form an enclosed chamber, and all of the acoustic transducer units included in the acoustic transducer reference element are located in the enclosed chamber.

In some embodiments, the acoustic transducer includes only one acoustic transducer reference element.

In some embodiments, the acoustic transducer unit is a capacitive micromechanical ultrasonic transducer unit.

In some embodiments, the sound-muffling layer includes an epoxy resin doped with tungsten powder.

In some embodiments, the acoustic transducer further includes: a first obtaining circuit configured to obtain a reference electrical signal according to a first electrical signal output by a first acoustic transducer element in a case where sound waves are not received by the first acoustic transducer element; a second obtaining circuit configured to obtain an actual detected electrical signal according to a second electrical signal output by a second acoustic transducer element in a case where sound waves are received by the second acoustic transducer element; and a noise reduction circuit configured to perform a noise reduction process on the actual detected electrical signal according to the reference electrical signal to obtain a noise-reduced signal as a final output electrical signal of the second acoustic transducer element in a case where sound waves are received by the second acoustic transducer element.

In some embodiments, the first acoustic transducer element and the second acoustic transducer element are one and the same acoustic transducer element.

In some embodiments, the first acoustic transducer element is the acoustic transducer reference element, and the second acoustic transducer element is the acoustic transducer operating element.

In some embodiments, the noise reduction circuit includes: a first processing circuit configured to perform a difference process on the actual detected electrical signal and the reference electrical signal.

In some embodiments, the first obtaining circuit includes: a first acquisition circuit configured to acquire the first electrical signal output by the first acoustic transducer element in a case where sound waves are not received by the first acoustic transducer element; and a second processing circuit configured to perform low-noise amplification and analog-to-digital conversion processes on the first electrical signal to obtain the reference electrical signal. The second obtaining circuit includes: a second acquisition circuit configured to acquire the second electrical signal output by the second acoustic transducer element in a case where sound waves are received by the second acoustic transducer element; and a third processing circuit configured to perform the low-noise amplification and analog-to-digital conversion processes on the second electrical signal to obtain the actual detected electrical signal.

DETAILED DESCRIPTION

In order to enable those skilled in the art to better understand the technical solutions of the present disclosure, an acoustic transducer and a driving method thereof provided by the present disclosure are described in detail below with reference to the accompanying drawings.

Ultrasound, which refers to sound waves with frequencies of 20 kHz to 1 GHz, is taken as an example of sound waves in the following description of the embodiments. It should be noted that the technical solutions of the present disclosure are also applicable to sound waves with other frequencies.

The method for driving an acoustic transducer provided by an embodiment of the present disclosure may be used for driving acoustic transducer elements in the acoustic transducer to operate.

Figure 1:
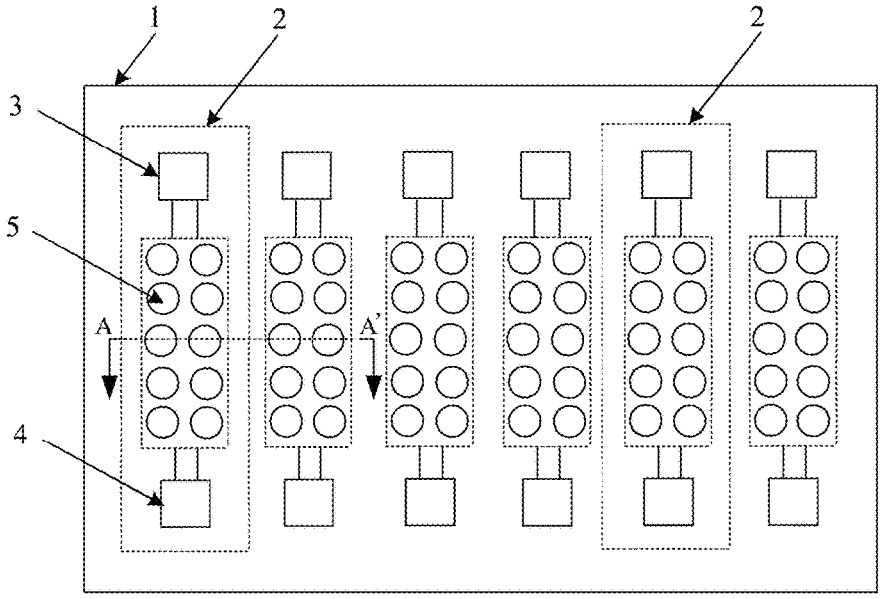
FIG. 1 is a top view of an acoustic transducer substrate according to an embodiment of the present disclosure.
Figure 2:
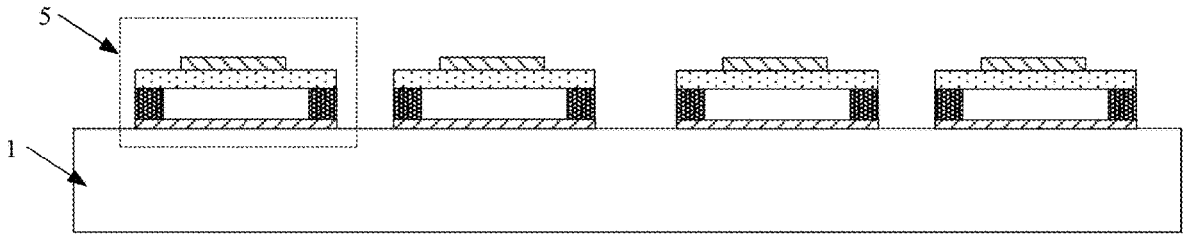
FIG. 2 is a sectional view taken along line A-A' in FIG. 1.

FIG. 1 is a top view of an acoustic transducer substrate according to an embodiment of the present disclosure, and FIG. 2 is a sectional view taken along line A-A' in FIG. 1. As shown in FIGS. 1 and 2, an acoustic transducer substrate is a core device in the acoustic transducer. The acoustic transducer substrate includes a plurality of acoustic transducer elements 2 disposed on a base substrate 1 and arranged in array. Each of the acoustic transducer elements 2 is provided therein with at least one acoustic transducer unit 5. The acoustic transducer unit 5 is provided with two electrodes configured to control an operating state of the acoustic transducer unit 5. The operating state of the acoustic transducer unit 5 may be controlled by controlling a voltage applied to the two electrodes. For the convenience of description, such two electrodes configured to control the operating state of the acoustic transducer unit are referred to as a first electrode and a second electrode.

Each of the acoustic transducer elements is provided with two signal terminals 3, 4, which are referred to as a first electrical signal terminal 3 and a second electrical signal terminal 4 respectively. The first electrode of the acoustic transducer unit 5 is electrically connected with the first electrical signal terminal 3 of the acoustic transducer element 2 in which the acoustic transducer unit 5 is disposed, and the second electrode of the acoustic transducer unit 5 is electrically connected with the second electrical signal terminal 4 of the acoustic transducer element 2 in which the acoustic transducer unit 5 is disposed. Therefore, in the case where the acoustic transducer element 2 includes a plurality of acoustic transducer units 5, the plurality of acoustic transducer units 5 are connected in parallel.

It should be noted that, as an example, FIG. 1 only shows six acoustic transducer elements 2 arranged in one row and six columns, and each of the acoustic transducer elements 2 includes ten acoustic transducer units 5 arranged in five rows and two columns. It should be understood by those skilled in the art that what is shown in FIG. 1 is merely an example, and the technical solutions disclosed in the present disclosure are not limited thereto. In practical application, the number and arrangement of the acoustic transducer elements 2 on the acoustic transducer substrate and the number and arrangement of the acoustic transducer units 5 included in each acoustic transducer element 2 may be designed as required.

Figure 3:
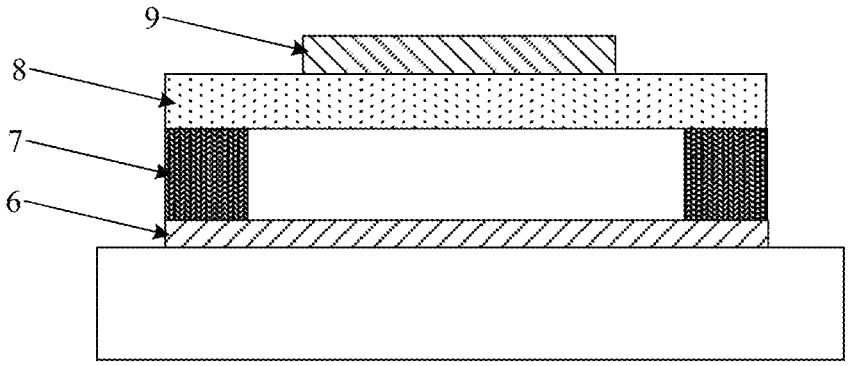
FIG. 3 is a schematic structural diagram of an acoustic transducer unit according to an embodiment of the present disclosure.

FIG. 3 is a schematic structural diagram of an acoustic transducer unit according to an embodiment of the present disclosure. As shown in FIG. 3, in an embodiment of the present disclosure, the acoustic transducer unit may be a capacitive micromechanical ultrasonic transducer unit; optionally, the acoustic transducer unit includes: a support pattern 7, a vibrating film 8, a top electrode 9 and a bottom electrode 6. The support pattern is located on the base substrate and forms an enclosed vibration cavity. The vibrating film 8 is located on a side of the support pattern distal to the base substrate. The top electrode 9 is located on a side of the vibrating film 8 distal to the base substrate, and the bottom electrode 6 is located on a side of the vibrating film 8 close to the base substrate. The bottom electrode 6 and the top electrode 9 may serve as the first electrode and the second electrode as described above, respectively. When ultrasonic testing is carried out, the acoustic transducer unit operates in a transmitting state first, and then is switched to a receiving state.

When the acoustic transducer unit is in the transmitting state, a forward DC bias voltage VDC is applied between the top electrode 9 and the bottom electrode 6 (i.e., signals are applied through the first electrical signal terminal 3 and the second electrical signal terminal 4), so that the vibrating film 8 is deformed to bend downward (i.e., toward the bottom electrode 6) under the function of electrostatic. Based on the above, an AC voltage VAC with a certain frequency f (the magnitude of f is set according to actual needs) is applied between the top electrode 9 and the bottom electrode 6 to excite the vibrating film 8 to reciprocate significantly (i.e., to move backwards and forwards in a direction toward to the bottom electrode 6 and a direction away from the bottom electrode 6) so as to realize the conversion of electric energy into mechanical energy. The vibrating film 8 radiates energy to a medium environment to generate ultrasonic waves. Part of the ultrasonic waves may be reflected by a surface of an object to be tested and return to the acoustic transducer unit, so as to be received and tested by the acoustic transducer unit.

When the acoustic transducer unit is in the receiving state, only a DC bias voltage is applied across the top electrode 9 and the bottom electrode 6. The vibrating film 8 reaches a static balance under the function of an electrostatic force and a film restoring force. When sound waves act on the vibrating film 8, the vibrating film 8 is excited to vibrate, so that a cavity distance between the top electrode 9 and the bottom electrode 6 changes, in turn capacitance between plates changes, thereby generating a detectable electrical signal. Based on the electrical signal, the received ultrasonic waves may be tested.

In the embodiments of the present disclosure, in the case where the acoustic transducer element 2 includes a plurality of acoustic transducer units 5, the first electrical signal terminal 3 of the acoustic transducer element is connected to bottom electrodes 6 of the plurality of acoustic transducer units. When the acoustic transducer element is in the receiving state, an electrical signal output from the first electrical signal terminal 3 of the acoustic transducer element is a superposition or sum of the electrical signals output from the bottom electrodes 6 connected to the first electrical signal terminal 3. The sound waves received by the acoustic transducer element can be tested based on the electrical signal output from the first electrical signal terminal 3.

It should be noted that the acoustic transducer unit in the embodiment of the present disclosure is not limited to that shown in FIGS. 2 and 3, and may be any type of existing acoustic transducer units, which is not described herein.

Figure 4:
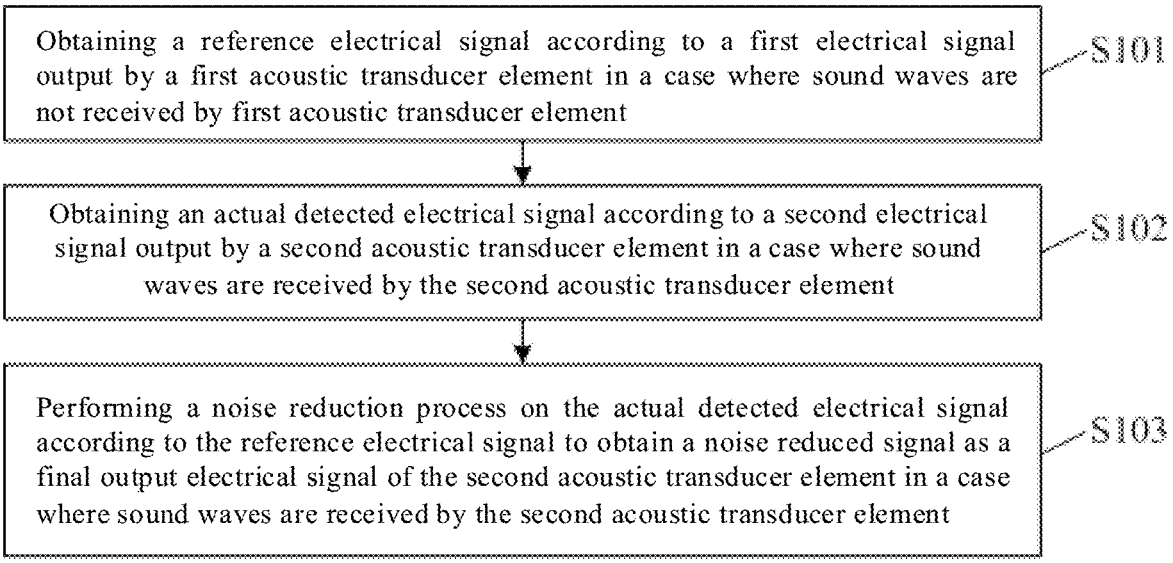
FIG. 4 is a flowchart illustrating a method for driving an acoustic transducer according to an embodiment of the present disclosure.

FIG. 4 is a flowchart illustrating a method for driving an acoustic transducer according to an embodiment of the present disclosure. As shown in FIG. 4, the method for driving the acoustic transducer includes steps S101 to S103.

At step S101, a reference electrical signal is obtained according to a first electrical signal output by a first acoustic transducer element when acoustic waves are not received by the first acoustic transducer element.

The reference electrical signal is derived from the first electrical signal. Optionally, the first electrical signal directly serves as the reference electrical signal.

The detection of self-noise of the first acoustic transducer element can be realized at step S101.

At step S102, an actual detected electrical signal is obtained according to a second electrical signal output by a second acoustic transducer element when the second acoustic transducer element receives acoustic waves.

The actual detected electrical signal is derived from the second electrical signal. Optionally, the second electrical signal directly serves as the actual detected electrical signal.

At step S102, the actual detected electrical signal includes the self-noise of the second acoustic transducer element and useful information.

At step S103, a noise reduction process is performed on the actual detected electrical signal according to the reference electrical signal to obtain a noise-reduced signal as a final output electrical signal of the second acoustic transducer element when the second acoustic transducer element receives acoustic waves.

At step S103, the noise reduction process may be performed on the actual detected electrical signal based on the reference electrical signal, so as to improve a signal-to-noise ratio of the signal.

In some embodiments, the self-noise of the actual detected electrical signal may be reduced or even eliminated by performing difference process on the actual detected electrical signal and the reference electrical signal. For example, the actual detected electrical signal at certain time has a voltage of 1V, the reference electrical signal at the certain time has a voltage of 0.1V, and the actual detected electrical signal at the certain time obtained after the difference processing has a voltage of 0.9V.

In some embodiments, the first acoustic transducer element and the second acoustic transducer element are one and the same acoustic transducer element. In such case, the "self-noise" detected in the step S101 is substantially the same as that included in the actual detected electrical signal detected in the step S102, and a good noise reduction effect may be achieved in the step S103.

It should be noted that, when the reference electrical signal is the first electrical signal and the actual detected electrical signal is the second electrical signal, after the final output electrical signal is obtained in the step S103, the final output electrical signal is further subjected to low-noise amplification and analog-to-digital conversion, and then is output to an external device for being further processed by the external device according to actual needs. The external device, for example an imaging device, can display an image according to the received signal. Imaging devices are conventional devices in the art, and a process of displaying images according to received signals belongs to a conventional technical means in the art, and is not described herein.

In the embodiments of the present disclosure, the second acoustic transducer element may be any of acoustic transducer elements 2 on the acoustic transducer substrate shown in FIG. 1. The sound waves received by the second acoustic transducer element may be detected based on the detection method provided by the embodiments of the present disclosure.

Figure 5:
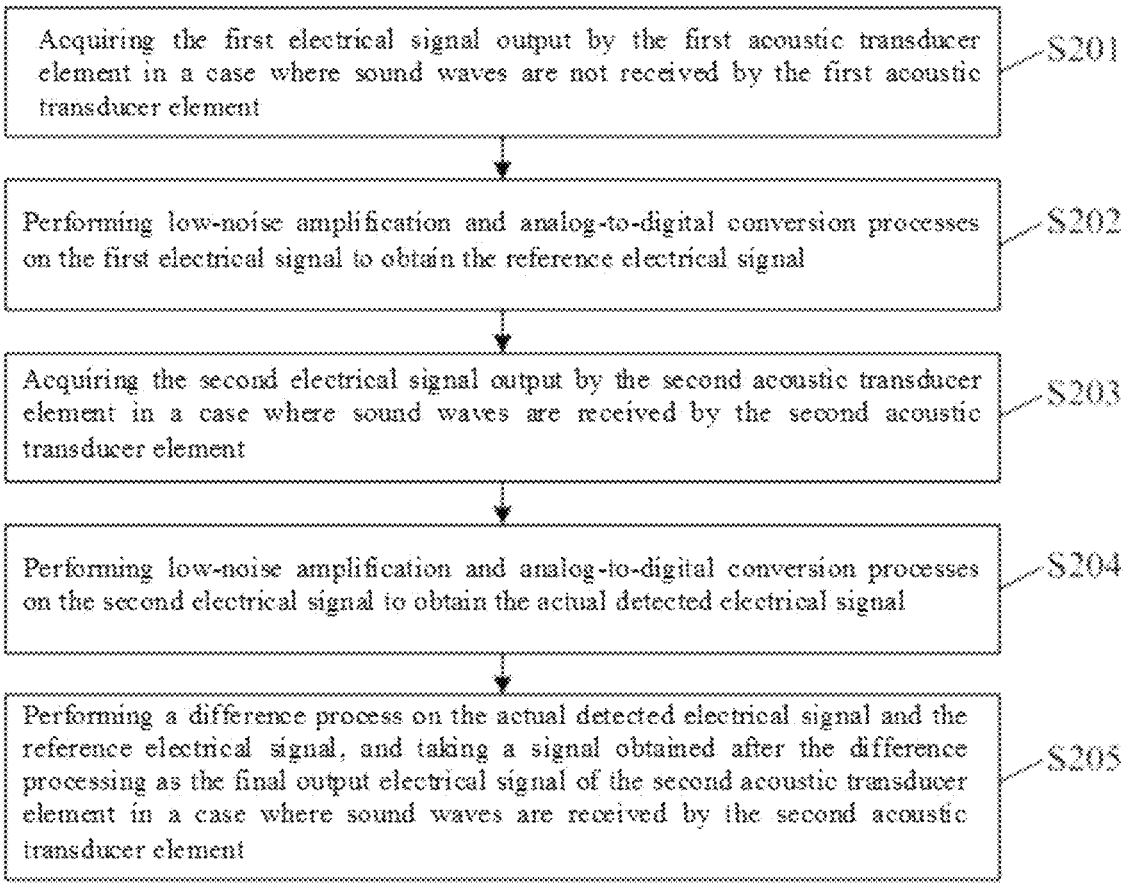
FIG. 5 is a flowchart illustrating a method for driving an acoustic transducer according to an embodiment of the present disclosure.

FIG. 5 is a flowchart illustrating a method for driving an acoustic transducer according to an embodiment of the present disclosure. As shown in FIG. 5, the method for driving the acoustic transducer includes steps S201 to S205.

At step S201, a first electrical signal output by the first acoustic transducer element in a case where sound waves are not received by the first acoustic transducer element is acquired.

At step S202, low-noise amplification and analog-to-digital conversion processes are performed on the first electrical signal to obtain a reference electrical signal.

At step S203, a second electrical signal output by the second acoustic transducer element in a case where the second acoustic transducer element receives the sound waves is acquired.

At step S204, the low-noise amplification and analog-to-digital conversion processes are performed on the second electrical signal to obtain an actual detected electrical signal.

At step S205, a difference process is performed on the actual detected electrical signal and the reference electrical signal to obtain a noise-reduced signal as a final output electrical signal of the second acoustic transducer element in a case where the second acoustic transducer element receives the sound waves.

The present embodiment is different from the previous embodiment in that the low-noise amplification and analog-to-digital conversion processes are performed on both of the signals output by the first acoustic transducer element and the second acoustic transducer element, and then a noise reduction process is performed on the actual detected electrical signal according to the reference electrical signal.

Figure 6:
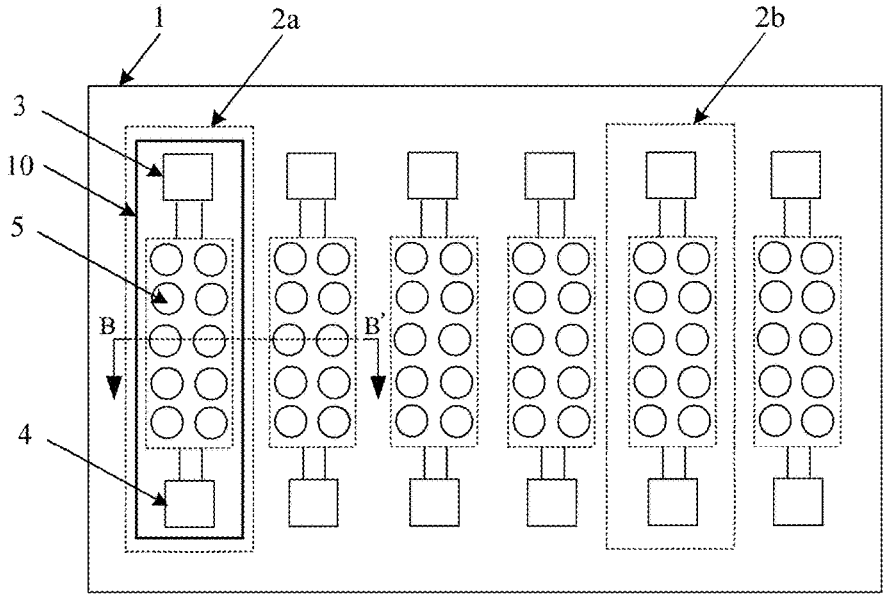
FIG. 6 is a top view of another acoustic transducer substrate according to an embodiment of the present disclosure.
Figure 7:
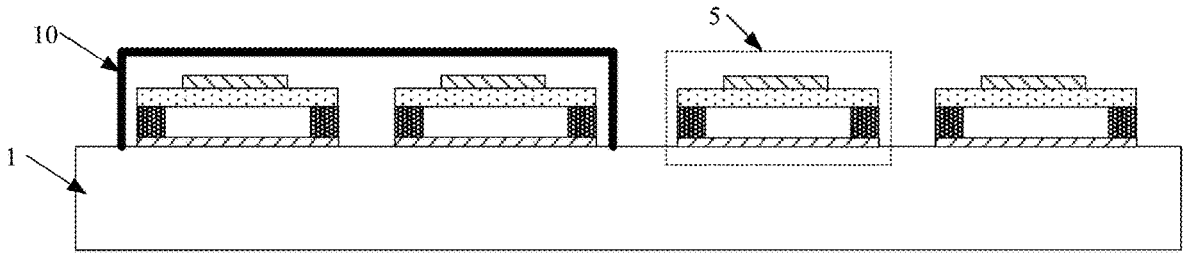
FIG. 7 is a sectional view taken along line B-B' in FIG. 6.

FIG. 6 is a top view showing another acoustic transducer substrate according to an embodiment of the present disclosure, and FIG. 7 is a sectional view taken along line B-B' in FIG. 6. As shown in FIGS. 6 and 7, the acoustic transducer substrate shown in FIG. 6 is different from the acoustic transducer substrate shown in FIG. 1 in that the acoustic transducer substrate shown in FIG. 6 includes an acoustic transducer reference element 2*a* and an acoustic transducer operating element 2*b*. The acoustic transducer reference element 2*a* includes the same number of acoustic transducer units 5 as that of the acoustic transducer operating element 2*b*. The acoustic transducer reference element 2*a* further includes: a sound-muffling layer 10 configured to shield the sound waves, so as to prevent the acoustic transducer units 5 in the acoustic transducer reference element 2*a* from being affected by the sound waves.

In some embodiments, the sound-muffling layer 10 and the base substrate 1 form an enclosed chamber, and all the acoustic transducer units 5 included in the acoustic transducer reference element 2*a* are located in the enclosed chamber.

In some embodiments, the number of the acoustic transducer reference elements 2*a* is 1. In practical application, considering that the acoustic transducer reference element 2*a* is configured to acquire the self-noise of the acoustic transducer element, it is enough to provide only one acoustic transducer reference element 2*a* for meeting such a requirement. Moreover, in a case where a certain total number of the acoustic transducer elements are disposed on the base substrate, only one acoustic transducer reference element 2*a* may be disposed on the base substrate, and the maximum number of the acoustic transducer operating elements 2*b* may be disposed on the base substrate, thereby improving a resolution of the acoustic transducer. In an embodiment of the present disclosure, the number of the acoustic transducer reference elements 2*a* may also be two or more, and is not limited by the technical solutions of the present disclosure.

In addition, according to an embodiment of the present disclosure, a position of the acoustic transducer reference element 2*a* may be designed according to actual needs. Taking the application of acoustic transducer in an imaging system as an example, since a final output electrical signal output from the acoustic transducer operating element 2*b* is input into the imaging device for displaying and an electrical signal output from the acoustic transducer reference element 2*a* is not used for displaying, the acoustic transducer reference element 2*a* may be arranged at the outermost layer of the array, so as to ensure the continuity and integrity of the images displayed by the imaging device. In the case where a plurality of acoustic transducer reference elements 2*a* are provided, the plurality of acoustic transducer reference elements 2*a* may be evenly distributed at the outermost layer of the array.

In some embodiments, the acoustic transducer unit 5 is a capacitive micromechanical ultrasonic transducer unit.

In some embodiments, a material of the sound-muffling layer 10 includes an epoxy resin doped with tungsten powder.

Figure 8:
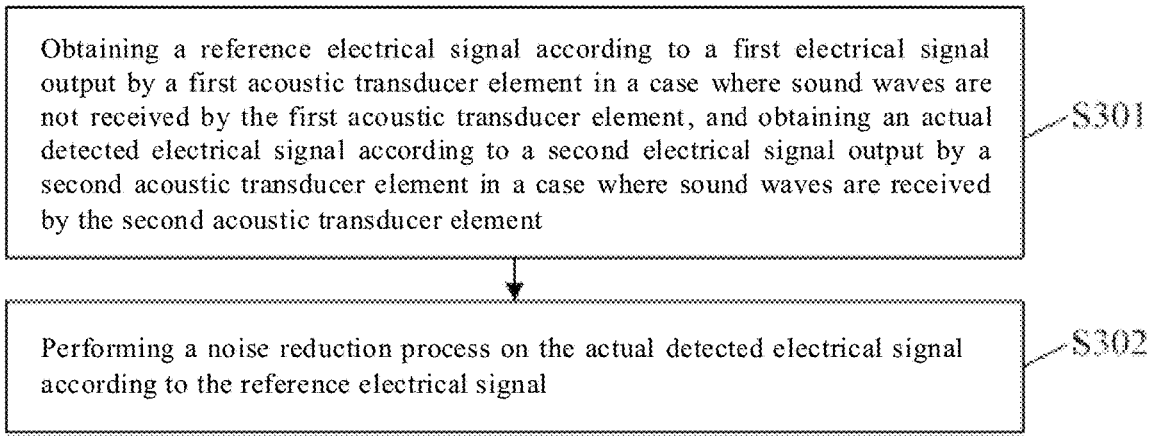
FIG. 8 is a flowchart illustrating a method for driving an acoustic transducer according to an embodiment of the present disclosure.

FIG. 8 is a flowchart illustrating a method for driving an acoustic transducer according to an embodiment of the present disclosure. As shown in FIG. 8, the driving method, which is based on the acoustic transducer substrate shown in FIG. 6, includes steps S301 and S302.

At step S301, a reference electrical signal is obtained according to a first electrical signal output by a first acoustic transducer element when the sound waves are not received by the first acoustic transducer element, and an actual detected electrical signal is obtained according to a second electrical signal output by a second acoustic transducer element when the second acoustic transducer element receives the sound waves.

In an embodiment, the first acoustic transducer element is an acoustic transducer reference element, and the second acoustic transducer element is an acoustic transducer operating element. That is, the first acoustic transducer element and the second acoustic transducer element are separate acoustic transducer elements. In such case, the acquisition of the reference electrical signal and the acquisition of the actual detected electrical signal may be performed synchronously.

In some embodiments, the low-noise amplification and analog-to-digital conversion processes are performed on the first electrical signal to obtain the reference electrical signal, and the low-noise amplification and analog-to-digital conversion processes are performed on the second electrical signal to obtain the actual detected electrical signal.

At step S302, a noise reduction process is performed on the actual detected electrical signal according to the reference electrical signal.

In some embodiments, in order to realize the noise reduction of the actual detected electrical signal, a difference process may be performed on the actual detected electrical signal and the reference electrical signal.

Figure 9:
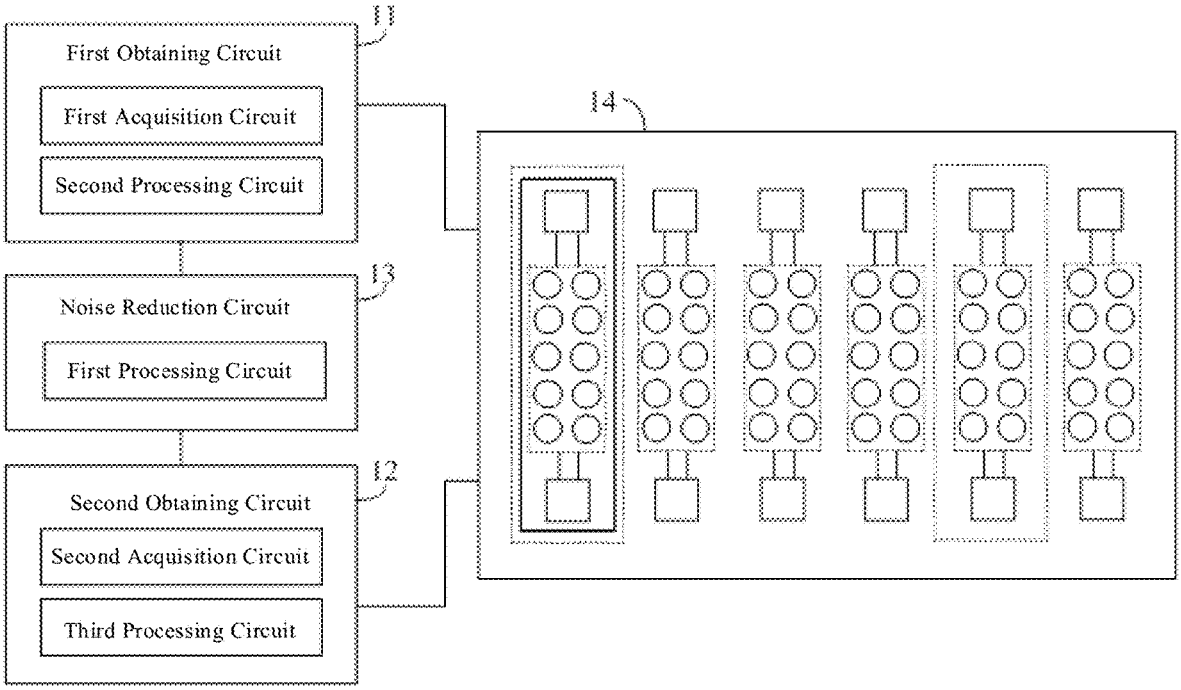
FIG. 9 is a block diagram illustrating a structure of an acoustic transducer according to an embodiment of the present disclosure.

FIG. 9 is a block diagram illustrating a structure of an acoustic transducer according to an embodiment of the present disclosure. As shown in FIG. 9, an acoustic transducer includes an acoustic transducer substrate 14. The acoustic transducer substrate 14 may be any one of the acoustic transducer substrates in above embodiments, and reference may be made to the above embodiments for the detailed description of the acoustic transducer substrate.

In some embodiments, the acoustic transducer further includes a driving system, which includes: a first obtaining circuit 11, a second obtaining circuit 12 and a noise reduction circuit 13.

The first obtaining circuit 11 is configured to obtain a reference electrical signal according to a first electrical signal output by a first acoustic transducer element when sound waves are not received by the first acoustic transducer element.

The second obtaining circuit 12 is configured to obtain an actual detected electrical signal according to a second electrical signal output by a second acoustic transducer element when the sound waves are received by second acoustic transducer element.

The noise reduction circuit 13 is configured to perform a noise reduction process on the actual detected electrical signal according to the reference electrical signal, and take a signal obtained after the noise reduction process as a final output electrical signal of the second acoustic transducer element in a case where the second acoustic transducer element receives the sound waves.

In some embodiments, the noise reduction circuit 13 includes: a first processing circuit configured to perform a difference process on the actual detected electrical signal and the reference electrical signal.

In some embodiments, the first acoustic transducer element and the second acoustic transducer element are one and the same acoustic transducer element.

In some embodiments, when the acoustic transducer substrate of FIG. 6 is used as the acoustic transducer substrate, the first acoustic transducer element is an acoustic transducer reference element, and the second acoustic transducer element is an acoustic transducer operating element.

In some embodiments, the first obtaining circuit 11 includes: a first acquisition circuit configured to acquire the first electrical signal output by the first acoustic transducer element in a case where the sound waves are not received by the first acoustic transducer element, and a second processing circuit configured to perform a low-noise amplification process and an analog-to-digital conversion process on the first electrical signal to obtain the reference electrical signal.

In some embodiments, the second obtaining circuit 12 includes: a second acquisition circuit configured to acquire the second electrical signal output by the second acoustic transducer element in a case where the second acoustic transducer element receives the sound waves, and a third processing circuit configured to perform a low-noise amplification process and an analog-to-digital conversion process on the second electrical signal to obtain the actual detected electrical signal.

The detailed description of the above circuits and units can be found in the above embodiments, and thus will not be repeated here.

It should be noted that the first obtaining circuit and the second obtaining circuit are one and the same circuit in some embodiments, that is, the circuit can be used for obtaining the reference electrical signal and can be further used for obtaining the actual detected electrical signal. In such case, the first acquisition circuit and the second acquisition circuit are one and the same unit, and the second processing circuit and the third processing circuit are one and the same unit.

It should be understood that the above embodiments are merely exemplary embodiments employed to illustrate the principles of the present disclosure, and the present disclosure is not limited thereto. Various changes and modifications may be made by those skilled in the art without departing from the spirit and essence of the present disclosure, and should be considered to fall within the scope of the present disclosure.

What is claimed is:

1. A method for driving an acoustic transducer, wherein the acoustic transducer comprises:

a first acoustic transducer element on a base substrate and comprising a plurality of acoustic transducer units arranged in an array, and a second acoustic transducer element on the base substrate and comprising a plurality of acoustic transducer units arranged in an array, and a number of the plurality of acoustic transducer units of the first acoustic transducer element is the same as a number of the plurality of acoustic transducer units of the second acoustic transducer element, and a sound-muffling layer covering all of the plurality of acoustic transducer units of the first acoustic transducer element and not covering the plurality of acoustic transducer units of the second acoustic transducer element, wherein the sound-muffling layer is configured to shield sound waves so as to prevent the acoustic transducer units of the first acoustic transducer element from being affected by the sound waves, and sound-muffling layer comprises a top surface and side walls, with the top surface being on a side of the plurality of acoustic transducer units of the first acoustic transducer element away from the base substrate, and the side walls covering side walls of the plurality of acoustic transducer units of the first acoustic transducer element, and wherein the method comprises:

obtaining a reference electrical signal according to a first electrical signal output by the first acoustic transducer element in a case where sound waves are not received by the first acoustic transducer element;

obtaining an actual detected electrical signal according to a second electrical signal output by the second acoustic transducer element in a case where sound waves are received by the second acoustic transducer element; and performing a noise reduction process on the actual detected electrical signal according to the reference electrical signal to obtain a noise-reduced signal as a final output electrical signal of the second acoustic transducer element in a case where sound waves are received by the second acoustic transducer element.

2. The method of claim 1, wherein performing the noise reduction process on the actual detected electrical signal according to the reference electrical signal comprises: performing a difference process on the actual detected electrical signal and the reference electrical signal.

3. The method of claim 1, wherein the first acoustic transducer element and the second acoustic transducer element are separate acoustic transducer elements.

4. The method of claim 1, wherein obtaining the reference electrical signal according to the first electrical signal output by the first acoustic transducer element in a case where sound waves are not received by the first acoustic transducer element comprises: acquiring the first electrical signal output by the first acoustic transducer element in a case where sound waves are not received by the first acoustic transducer element, and performing low-noise amplification and analog-to-digital conversion processes on the first electrical signal to obtain the reference electrical signal, and obtaining the actual detected electrical signal according to the second electrical signal output by the second acoustic transducer element in a case where sound waves are received by the second acoustic transducer element comprises: acquiring the second electrical signal output by the second acoustic transducer element in a case where sound waves are received by the second acoustic transducer element, and performing the low-noise amplification and analog-to-digital conversion processes on the second electrical signal to obtain the actual detected electrical signal.

5. The method of claim 1, wherein the first acoustic transducer element and the second acoustic transducer element are separate acoustic transducer elements, obtaining the reference electrical signal according to the first electrical signal output by the first acoustic transducer element in a case where sound waves are not received by the first acoustic transducer element comprises: acquiring the first electrical signal output by the first acoustic transducer element in a case where sound waves are not received by the first acoustic transducer element, and performing low-noise amplification and analog-to-digital conversion processes on the first electrical signal to obtain the reference electrical signal, obtaining the actual detected electrical signal according to the second electrical signal output by the second acoustic transducer element in a case where sound waves are received by the second acoustic transducer element comprises: acquiring the second electrical signal output by the second acoustic transducer element in a case where sound waves are received by the second acoustic transducer element, and performing the low-noise amplification and analog-to-digital conversion processes on the second electrical signal to obtain the actual detected electrical signal, and performing the noise reduction process on the actual detected electrical signal according to the reference electrical signal comprises: performing a difference process on the actual detected electrical signal and the reference electrical signal.

6. An acoustic transducer, comprising:

an acoustic transducer reference element on a base substrate and comprising a plurality of acoustic transducer units arranged in an array, and an acoustic transducer operating element on the base substrate and comprising, a plurality of acoustic transducer units arranged in an array, and a number of the plurality of acoustic transducer units of the acoustic transducer reference element is the same as a number of the plurality of acoustic transducer units of the acoustic transducer operating element, and a sound-muffling layer, covering all of the plurality of acoustic transducer units of the acoustic transducer reference element and not covering the plurality of acoustic transducer units of the acoustic transducer operating element, wherein the sound-muffling layer is configured to shield sound waves so as to prevent the plurality of acoustic transducer units of the acoustic transducer reference element from being affected by the sound waves, and sound-muffling layer comprises a top surface and side walls, with the top surface being on a side of the plurality of acoustic transducer units of the acoustic transducer reference element away from the base substrate, and the side walls covering side walls of the plurality of acoustic transducer units of the acoustic transducer reference element.

7. The acoustic transducer of claim 6, wherein the sound-muffling layer and the base substrate form an enclosed chamber, and all of the acoustic transducer units in the acoustic transducer reference element are in the enclosed chamber.

8. The acoustic transducer of claim 6, comprising only one acoustic transducer reference element.

9. The acoustic transducer of claim 6, wherein the acoustic transducer unit is a capacitive micromechanical ultrasonic transducer unit.

10. The acoustic transducer of claim 9, wherein the sound-muffling layer comprises an epoxy resin doped with tungsten powder.

11. The acoustic transducer of claim 6, further comprising:

a first obtaining circuit configured to obtain a reference electrical signal according to a first electrical signal output by a first acoustic transducer element in a case where sound waves are not received by the first acoustic transducer element;

a second obtaining circuit configured to obtain an actual detected electrical signal according to a second electrical signal output by a second acoustic transducer element in a case where sound waves are received by the second acoustic transducer element; and a noise reduction circuit configured to perform a noise reduction process on the actual detected electrical signal according to the reference electrical signal to obtain a noise-reduced signal as a final output electrical signal of the second acoustic transducer element in a case where sound waves are received by the second acoustic transducer element.

12. The acoustic transducer of claim 11, wherein the first acoustic transducer element is the acoustic transducer reference element, and the second acoustic transducer element is the acoustic transducer operating element.

13. The acoustic transducer of claim 11, wherein the noise reduction circuit comprises:

a first processing circuit configured to perform a difference process on the actual detected electrical signal and the reference electrical signal.

14. The acoustic transducer of claim 11, wherein the first obtaining circuit comprises:

a first acquisition circuit configured to acquire the first electrical signal output by the first acoustic transducer element in a case where sound waves are not received by the first acoustic transducer element, and a second processing circuit configured to perform low-noise amplification and analog-to-digital conversion processes on the first electrical signal to obtain the reference electrical signal, and the second obtaining circuit comprises:

a second acquisition circuit configured to acquire the second electrical signal output by the second acoustic transducer element under in a case where sound waves are received by the second acoustic transducer element, and a third processing circuit configured to perform the low-noise amplification and analog-to-digital conversion processes on the second electrical signal to obtain the actual detected electrical signal.

* * * * *